US007850094B2

(12) United States Patent
Richmond et al.

(10) Patent No.: US 7,850,094 B2
(45) Date of Patent: Dec. 14, 2010

(54) ARC ADJUSTABLE ROTARY SPRINKLER HAVING FULL-CIRCLE OPERATION

(75) Inventors: Douglas Scott Richmond, Tucson, AZ (US); Kevin James Markley, Casa Grande, AZ (US); Joe L. Romack, Tucson, AZ (US); Daniel Roger St. George, Vail, AZ (US)

(73) Assignee: Rain Bird Corporation, Azusa, CA (US)

( * ) Notice: Subject to any disclaimer, the term of this patent is extended or adjusted under 35 U.S.C. 154(b) by 152 days.

(21) Appl. No.: 12/353,139

(22) Filed: Jan. 13, 2009

(65) Prior Publication Data

US 2010/0176217 A1 Jul. 15, 2010

(51) Int. Cl.

| | |
|---|---|
| ***B05B 3/04*** | (2006.01) |
| ***B05B 3/02*** | (2006.01) |
| ***B05B 3/00*** | (2006.01) |
| ***B05B 15/10*** | (2006.01) |

(52) U.S. Cl. ..... 239/206; 239/203; 239/204; 239/240

(58) Field of Classification Search ..... 239/200–206, 239/225.1, 237, 240, 242, DIG. 1
See application file for complete search history.

(56) References Cited

U.S. PATENT DOCUMENTS

| | | | |
|---|---|---|---|
| 2,187,549 | A | 1/1940 | Thompson |
| 2,268,855 | A | 1/1942 | Brooks |
| 3,263,930 | A | 8/1966 | Friedmann et al. |
| 3,334,817 | A | 8/1967 | Miller et al. |
| 3,521,822 | A | 7/1970 | Friedmann et al. |
| 3,523,647 | A | 8/1970 | Radecki |
| 3,655,132 | A | 4/1972 | Rosic |
| 3,782,638 | A | 1/1974 | Bumpstead |
| 3,921,912 | A | 11/1975 | Hayes |
| 4,091,997 | A | 5/1978 | Ridgway |
| 4,417,691 | A | 11/1983 | Lockwood |
| 4,625,914 | A | 12/1986 | Sexton et al. |
| 4,650,118 | A | 3/1987 | Saarem et al. |
| 4,681,259 | A | 7/1987 | Troup et al. |
| 4,702,417 | A | 10/1987 | Hartley et al. |
| 4,708,291 | A | 11/1987 | Grundy |
| 4,718,605 | A | 1/1988 | Hunter |
| 4,773,595 | A | 9/1988 | Livne |
| 4,784,325 | A | 11/1988 | Walker et al. |
| 4,787,558 | A | 11/1988 | Sexton et al. |
| 4,819,875 | A | 4/1989 | Beal |
| 4,867,379 | A | 9/1989 | Hunter |
| 4,892,252 | A | 1/1990 | Bruninga |
| 4,898,332 | A | 2/1990 | Hunter et al. |
| 4,901,924 | A | 2/1990 | Kah, Jr. |
| 4,919,337 | A | 4/1990 | Van Leeuwen et al. |
| 4,925,098 | A | 5/1990 | Di Paola |
| 4,955,542 | A | 9/1990 | Kah, Jr. |

(Continued)

*Primary Examiner*—Darren W Gorman
(74) *Attorney, Agent, or Firm*—Fitch, Even, Tabin & Flannery

(57) ABSTRACT

A rotary sprinkler is provided that includes a housing having a riser assembly and a rotatable nozzle turret on an upper end of the riser assembly. The sprinkler includes an arc setting assembly that enables part-circle operation of the turret and a selector assembly that permits selection of either part-circle or full-circle operation of the nozzle turret where the components of the selector assembly are generally separate from the components of the arc setting assembly.

29 Claims, 12 Drawing Sheets

U.S. PATENT DOCUMENTS 4,967,961 A 11/1990 Hunter
4,971,256 A 11/1990 Malcolm
4,972,993 A * 11/1990 Van Leeuwen ..... 239/206
5,031,833 A 7/1991 Alkalay et al.
5,048,757 A 9/1991 Van Leeuwen
5,098,021 A 3/1992 Kah, Jr.
5,115,977 A 5/1992 Alkalay et al.
5,148,990 A 9/1992 Kah, Jr.
5,148,991 A 9/1992 Kah, Jr.
5,174,501 A * 12/1992 Hadar ..... 239/205
5,330,103 A 7/1994 Eckstein
5,383,600 A 1/1995 Verbera et al.
5,417,370 A 5/1995 Kah, Jr.
5,641,122 A 6/1997 Alkalai et al.
5,653,390 A 8/1997 Kah, Jr.
5,673,855 A 10/1997 Nguyen et al.
5,676,315 A 10/1997 Han
5,685,486 A 11/1997 Spenser
5,695,123 A 12/1997 Le
5,758,827 A 6/1998 Van Le et al.
5,823,440 A 10/1998 Clark
5,899,386 A 5/1999 Miyasato et al.
5,938,122 A 8/1999 Heren et al.
5,992,760 A 11/1999 Kearby
6,029,907 A 2/2000 McKenzie
6,039,268 A 3/2000 Grundy et al.
6,042,021 A 3/2000 Clark
6,050,502 A * 4/2000 Clark ..... 239/237
6,085,995 A 7/2000 Kah, Jr. et al.
6,155,493 A 12/2000 Kearby et al.
6,209,801 B1 4/2001 Kearby et al.
6,478,237 B2 11/2002 Kearby et al.
6,607,147 B2 8/2003 Schneider et al.
6,732,950 B2 5/2004 Ingham, Jr. et al.
6,732,952 B2 5/2004 Kah, Jr.
6,814,305 B2 11/2004 Townsend
6,817,543 B2 11/2004 Clark
6,840,460 B2 1/2005 Clark
6,869,026 B2 3/2005 McKenzie et al.
6,883,727 B2 4/2005 De Los Santos
6,942,164 B2 9/2005 Walker
6,945,471 B2 9/2005 McKenzie et al.
7,017,831 B2 3/2006 Santiago et al.
7,028,920 B2 4/2006 Hekman et al.
7,040,553 B2 5/2006 Clark
7,168,632 B2 1/2007 Kates
7,287,711 B2 10/2007 Crooks
7,337,988 B2 3/2008 McCormick et al.
7,392,956 B2 7/2008 McKenzie et al.
7,404,525 B2 7/2008 Santiago et al.
2004/0050958 A1* 3/2004 McKenzie et al. ..... 239/242
2005/0194464 A1* 9/2005 Bruninga ..... 239/200
2006/0049275 A1 3/2006 Santiago et al.
2006/0273196 A1* 12/2006 Crooks ..... 239/242
2007/0119978 A1 5/2007 Wang et al.
2008/0054092 A1 3/2008 Alexander et al.
2008/0087743 A1 4/2008 Govrin et al.
2008/0142618 A1 6/2008 Smith et al.
2008/0308650 A1 12/2008 Clark
2009/0072048 A1 3/2009 Renquist et al.

* cited by examiner

ARC ADJUSTABLE ROTARY SPRINKLER HAVING FULL-CIRCLE OPERATION

FIELD

The field relates to irrigation sprinklers and, more particularly, to rotary irrigation sprinklers having part-circle and full-circle operation.

BACKGROUND

Pop-up irrigation sprinklers are typically buried in the ground and include a stationary housing and a riser assembly mounted within the housing that cycles up and down during an irrigation cycle. During irrigation, pressurized water typically causes the riser assembly to elevate through an open upper end of the housing and rise above the ground level to distribute water to surrounding terrain. The pressurized water causes the riser assembly to travel upwards against the bias of a spring to the elevated spraying position to distribute water to surrounding terrain through one or more spray nozzles. When the irrigation cycle is completed, the pressurized water supply is shut off and the riser is spring-retracted back into the stationary housing.

A rotary irrigation sprinkler commonly includes a rotatable nozzle turret mounted at the upper end of the riser assembly. The turret includes one or more spray nozzles for distributing water and is rotated through an adjustable arcuate water distribution pattern. Rotary sprinklers commonly include a water-driven motor to transfer energy of the incoming water into a source of power to rotate the turret. One common mechanism uses a water-driven turbine and a gear reduction system to convert the high speed rotation of the turbine into relatively low speed turret rotation. During normal operation, the turret rotates to distribute water outwardly over surrounding terrain in an arcuate pattern.

Rotary sprinklers may also employ arc adjustment mechanisms to change the relative arcuate distance between two stops that define the limits of rotation for the turret. One stop is commonly fixed with respect to the turret while the second stop can be selectively moved arcuately relative to the turret to increase or decrease the desired arc of coverage. The drive motor may employ a tripping tab that engages the stops and shifts the direction of rotation to oscillate the turret in opposite rotary directions in order to distribute water of the designated arc defined by the stops.

There are also rotary sprinklers that can select either part-circle rotation of the turret or full-circle rotation of the turret. In the full-circle rotation mode, the turret does not oscillate between the stops, but simply rotates a full 360° without reversing operation. Such selectable rotary sprinklers generally employ a switching mechanism that decouples the reversing mechanism from the stops. For example, some types of switchable rotors shift the arc stops to a position that does not engage the tripping tab. Such designs have the shortcoming that the adjustable stops need to be constructed for both radial adjustment for part-circle operation and also for adjustment in some additional manner in order to avoid the tripping tab. These designs are also less desirable because, in many cases, the part-circle settings of the arc stops may need to be re-established each time the sprinkler is shifted back to part-circle operation.

Other types of switchable sprinklers rely on mechanisms that allow either the arc stops or trip tab to cam around each other due to the stop or tab being resiliently bent. These types of configurations are less robust because the camming component can wear out over time as a result of its repeated bending during full-circle operation. In addition, the camming engagement of the trip tab and/or arc stops during full-circle operation may also cause some unintended movement of the arc stops, which could affect the arc of watering once the sprinkler is shifted back into part-circle mode and require resetting of the desired arc stop locations.

Yet other types of switchable sprinklers employ mechanisms that separate the shifting device from the arc stops, but still allow the stops to engage the tripping tab during operation. These configurations are also less desirable due to the added stress imparted to the tripping tab because it is always engageable with the arc stops in both a full-circle and a part-circle mode. In each prior case, the intricacy of these prior devices renders such sprinkler configurations overly complex, difficult to manufacture, and with many parts potentially prone to wear and tear over time. Also, due to the engagement of the arc stops and tripping tab even during full-circle operation, such prior designs may also require additional re-adjustment of the sprinkler when selecting the part-circle operation after watering in a full-circle mode due to unintended shifting of the arc stops through the continued engagement with the trip tab.

DETAILED DESCRIPTION OF THE PREFERRED EMBODIMENT

Figure 1:
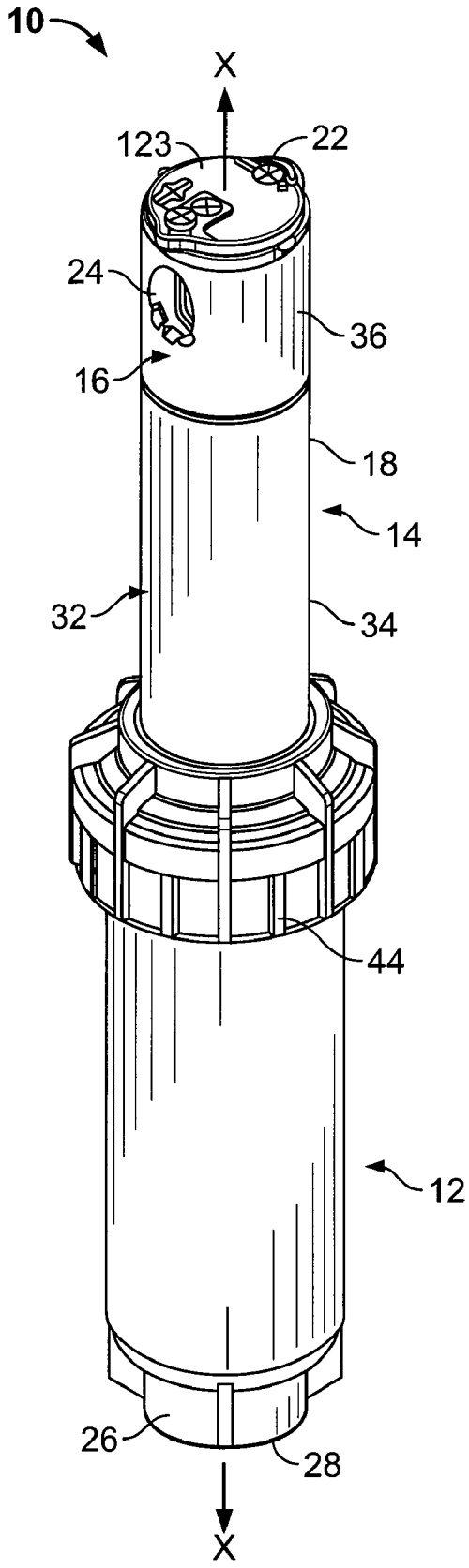
FIG. 1 is a perspective view of an irrigation sprinkler rotor shown with a riser assembly in an elevated position.
Figure 2:
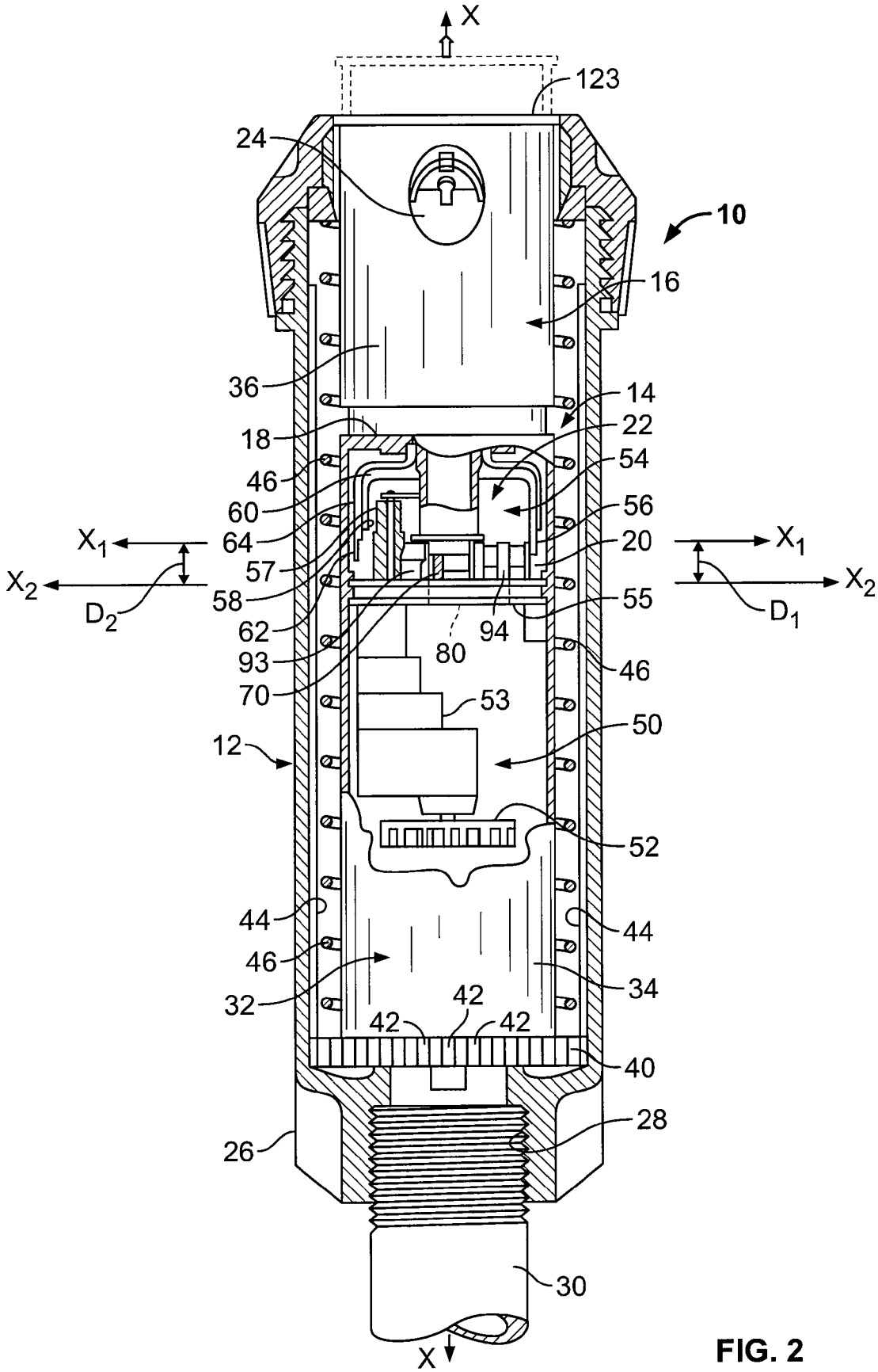
FIG. 2 is a cross-sectional view of the irrigation sprinkler shown with the riser assembly in a retracted position.

As shown in FIGS. 1 and 2, one embodiment of a rotary pop-up sprinkler 10 is provided that includes a housing 12 having a longitudinal axis X, a pop-up riser assembly 14 coupled with the housing 12, and a rotatable nozzle turret 16 on an upper end 18 of the riser assembly 14. In one aspect, the sprinkler 10 includes an arc setting assembly 20 that enables reversing, part-circle operation of the turret 16 and a selector assembly 22 that permits selection of either part-circle or full-circle operation of the nozzle turret 16 where the components of the selector assembly 22 are generally separate from the components of the arc setting assembly 20.

As described in more detail below, the selector assembly 22 initiates full-circle watering by shifting a trip member, which is used to reverse the direction of watering, to an operational position that allows the arc setting assembly 20 to bypass the trip member during full-circle watering and, preferably, to bypass the trip member completely without any engagement therewith during full-circle watering. Full-circle watering can be selected without the need to shift or adjust the arc setting assembly 20, such as left and right arc stops, as typically found in prior designs. Therefore, the part-circle watering settings of the sprinkler 10 do not need to be disturbed to select full circle watering, and as a result, the part-circle settings do not need to be reset when part-circle watering is again used. Due to the separation of the arc setting components and the full-circle and part-circle selection components, the sprinklers provided herein generally exhibit less wear and tear on the arc setting assembly and/or trip member because the sprinkler's trip member is spaced from the arc setting components during full-circle watering.

In general, the riser assembly 14 travels cyclically between a spring-retracted position where the riser 14 is retracted into the housing 12 (FIG. 2) and an elevated spraying position where the riser 14 is elevated out of the housing 12 (FIG. 1). The riser assembly 14 includes the rotatable nozzle turret 16 having at least one nozzle 24 therein for distributing water over a ground surface area. When the supply water is on, the riser assembly 14 extends above ground level so that water can be distributed from the nozzle 24 over the ground surface area for irrigation. When the water is shut off at the end of a watering cycle, the riser assembly 14 retracts into the housing 12 where it is protected from damage.

The housing 12 generally provides a protective covering for the riser assembly 14 and serves as a conduit for incoming water under pressure. The housing 12 preferably has the general shape of a cylindrical tube and is preferably made of a sturdy lightweight injection molded plastic or similar material. The housing 12 has a lower end 26 with an inlet 28 that may be coupled to a water supply pipe 30.

The riser assembly 14 includes a non-rotatable, riser stem 32 with a lower end 34 and the upper end 18. The rotatable turret 16 is rotatably mounted on the upper end 18 of the riser stem 32. The rotatable turret 16 includes a housing 36 that rotates relative to the stem 32 to water a predetermined pattern, which is adjustable from part-circle, reversing rotation between 0° to 360° arcuate sweeps or to full-circle, non-reversing rotation.

The riser stem 32 may be an elongated hollow tube, which is preferably made of a lightweight molded plastic or similar material. The lower stem end 34 may includes a radially projecting annular flange 40 as shown in FIG. 2. The flange 40 preferably includes a plurality of circumferentially spaced grooves 42 that cooperate with internal ribs 44 of the housing 12 to prevent the stem 32 from rotating relative to the housing 12 when it is extended to the elevated position. A coil spring 46 for retracting the riser assembly 14 back into the housing 12 is disposed in the housing 12 about an outside surface of the riser assembly 14.

Figure 3:
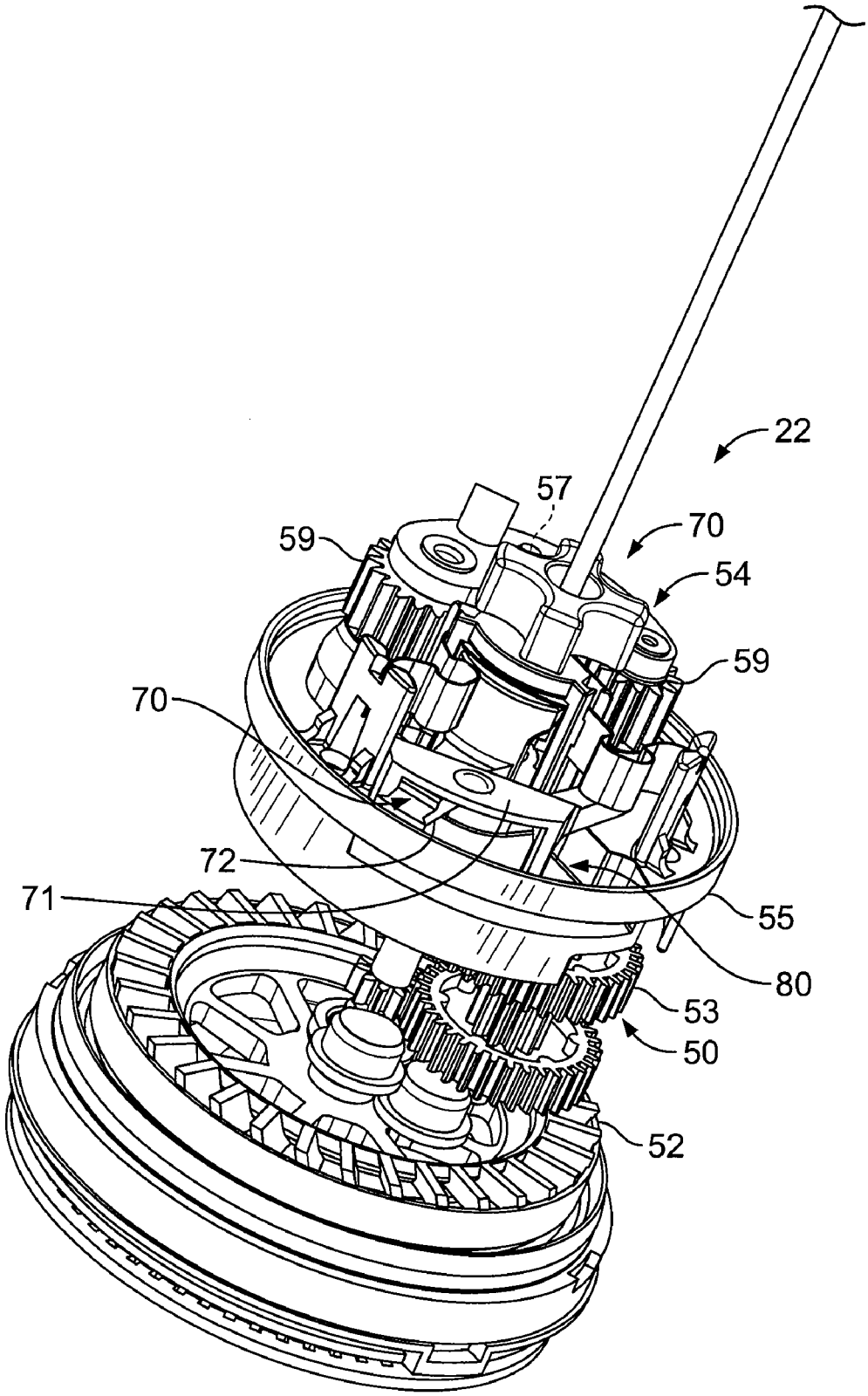
FIG. 3 is a perspective view of a drive mechanism, transmission, and portions of a selector assembly within the riser of the irrigation sprinkler.

Internal to the riser assembly 14, as generally shown in FIGS. 2 and 3, the sprinkler 10 may include a drive mechanism 50, such as a gear-drive assembly, having a water-driven turbine 52 that rotates a gear train 53 for turning the nozzle turret 16. The gear train 53 may be coupled to a shiftable transmission 54 mounted on a support or gear plate 55. The transmission 54 preferably has a drive gear 57 rotated via the output of the drive mechanism 50. In this example of the transmission, the drive gear 57 is coupled to opposite terminal gears 59 that rotate in opposite directions. The transmission 54 is shiftable to engage one of the opposite terminal gears 59 with a ring gear 58 (FIG. 2) mounted for rotation of the nozzle turret 16 as generally described in more detail below. Therefore, depending on which terminal gear 59 is positioned engage the ring gear 58 and to rotate the nozzle turret 16, it rotates in either a forward or reverse rotational direction.

Figure 4:
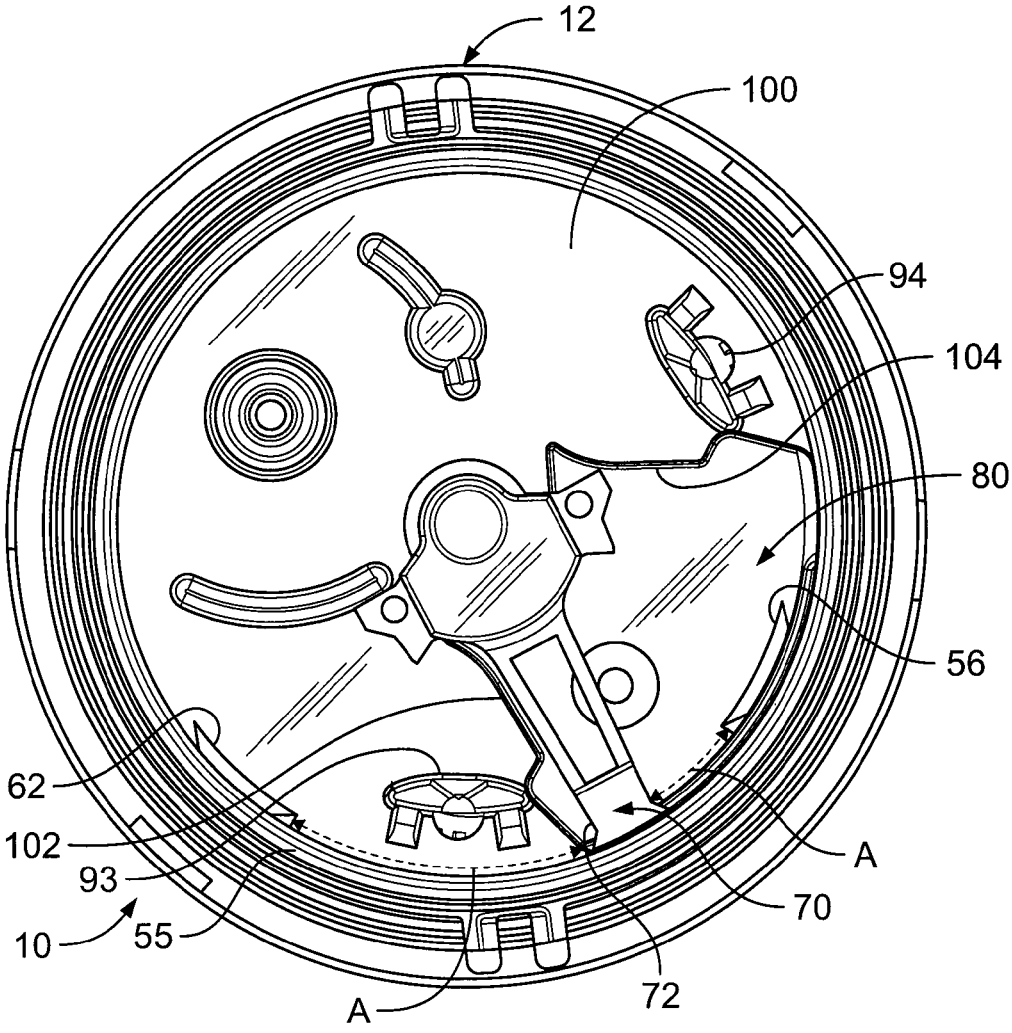
FIG. 4 is a cross-sectional view of portions of the riser assembly.
Figure 9:
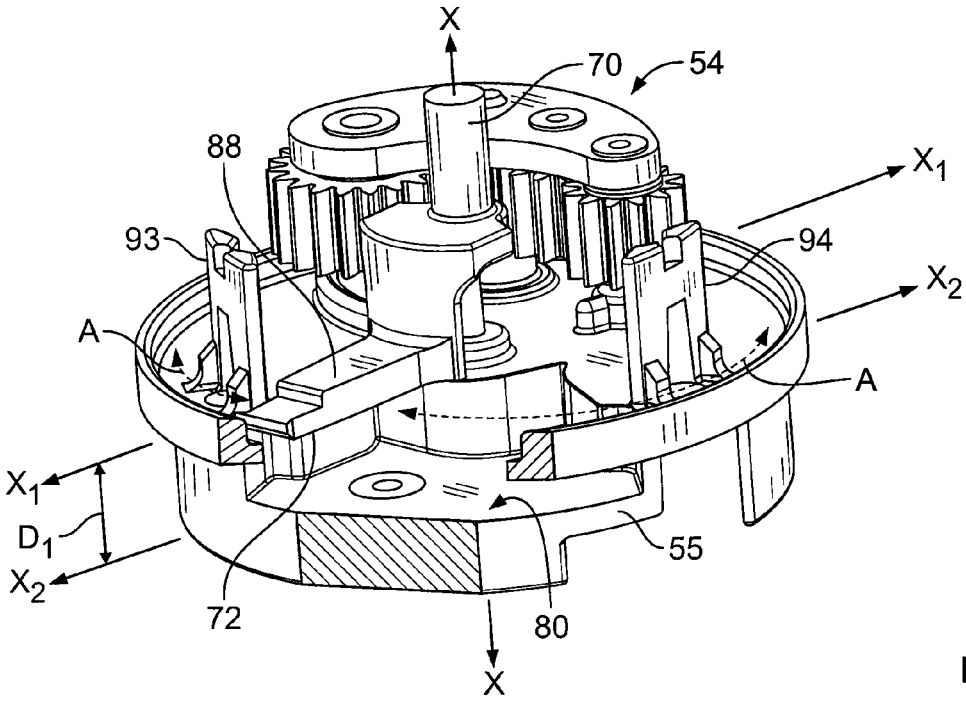
FIG. 9 is a perspective view of the trip member shown in a first operational position relative to a support plate.

The sprinkler's arc setting assembly 20 allows manual adjustment of the arcuate sweep settings of the nozzle turret 16. Referring again to FIG. 2, one form of the arc setting assembly 20 includes a first arc adjustment or trip stop 56 carried by the ring gear 58. By one approach, the first stop 56 is formed as a downwardly projecting tab extending from a lower end of a cup-shaped driven member 60 having the ring gear 58 on an inner surface thereof. The ring gear 58 is driven by one of the terminal gears 59 (depending on the position of the transmission 54) and coupled to rotate the nozzle turret 16 via the cup-shaped member 60. A second arc adjustment or trip stop 62 is formed on a second cup-shaped adjustment member 64 concentrically disposed over the driven member 60 and normally coupled thereto for rotation therewith. By one approach, the second trip stop 62 may be arcuately adjusted to alter the arcuate sweep of the nozzle turret. As best shown in FIGS. 4 and 9, the first and second stops 56 and 62, therefore, are preferably mounted for rotation with the nozzle turret 16 and traverse or travel along a path A in conjunction with the rotation of the nozzle turret 16. Preferably, path A is an arcuate path relative to the housing body 12 and/or the support plate 55. Depending on the particular settings of the stops 56 and 62, the length of the path A will generally vary.

To effect shifting of the transmission 54 (and reversing operation of the nozzle turret 16), a trip member 70, such as a trip arm or trip lever, is coupled to the transmission 54 via a trip plate 71 (to which the drive gear and terminal gears are mounted) and operable to shift the transmission 54 upon being toggled by alternative engagement with one of the stops 56 or 62. By one approach, the trip lever 70 may be mounted on the support plate 55 in a first operational position for part-circle operation where at least a portion 72 (FIGS. 3, 4, and 9) of the lever 70 is positioned within the path A of the stops 56 and 62 so that the lever 70 can be engaged alternatively by both the first stop 56 and the second stop 62 to effect shifting of the transmission 54. When the lever 70 is toggled by engagement with one of the stops 56 or 62, the lever 70 causes a corresponding shifting of the trip plate 71 in generally the same direction. Because the trip plate 71 is mounted to the transmission 54, movement of the trip plate 71 generally causes the transmission to toggle between engagements of the terminal gears 59 with the ring gear 58.

In this first operational position of the trip lever 70, at least the portion 72 of the trip lever 70 (and in some cases, the entire trip lever itself) generally extends in a first operational plane X1, which is preferably generally transverse to the housing longitudinal axis X as generally illustrated in FIGS. 2 and 9. This first operational plane X1 also encompasses both the first and second stops 56 and 62 and the path A of the stops. When the lever 70 or at least the lever portion 72 is positioned in this first operational plane X1 and within the path A as best shown in FIG. 9, engagement by one of the stops 56 or 62 with the lever portion 72 toggles the lever 70 back and forth to effect shifting of the trip plate 71 and the transmission 54, which alternates engagement of one of the terminal gears 59 with the ring gear 58 for reversing rotation of the nozzle turret 16.

One example of a suitable gear-drive mechanism, shiftable transmission, and arc setting assembly can be found in U.S. Pat. No. 5,383,600, which is incorporated herein by reference in its entirety and provides further details of these sub-assemblies. It will be appreciated however, that other assemblies, components, and mechanisms that drive, shift, and/or adjust the nozzle turret rotation may also be used to operate the sprinkler 10 in part-circle operation.

To shift between part-circle and full-circle operation, the sprinkler 10 includes the selector assembly 22 that shifts the nozzle turret 16 into full-circle operation. To select full-circle operation, the assembly 22 preferably does not require adjustment or shifting of the arc setting assembly 20 (including the arc stops 56 or 62) and preferably also does not require adjustment or shifting of the transmission 54 or the gear-drive assembly 50. As a result, when the sprinkler is shifted back to part-circle operation, the arc set points generally do not need to be reset. By one approach, the selector assembly 22 is coupled to the trip member 70 to effect such shifting, but at the same time is also decoupled from the drive mechanism.

Figure 10:
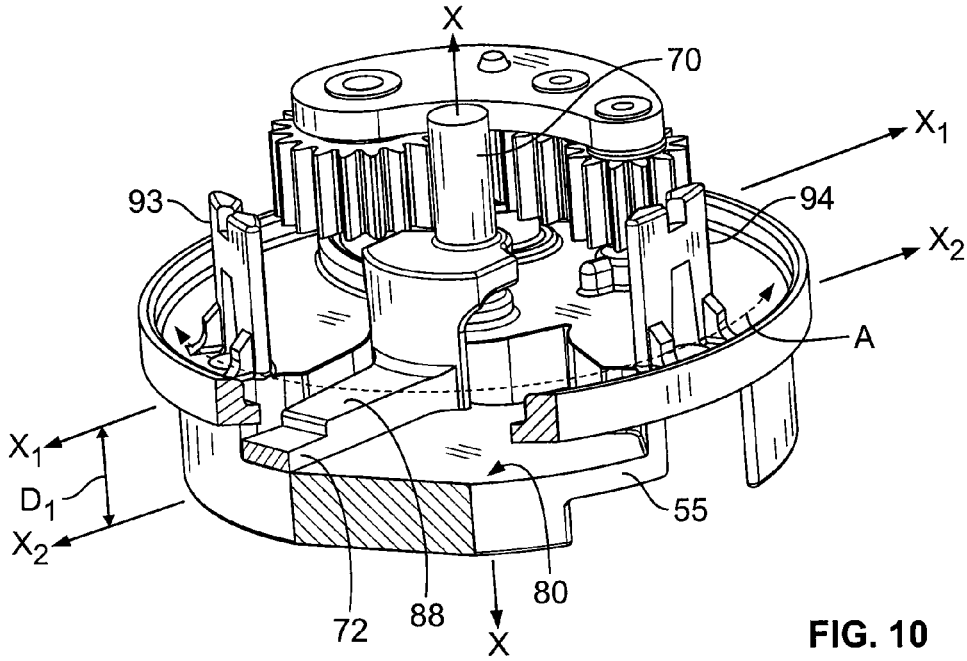
FIG. 10 is a perspective view of the trip member shown in a second operational position relative to a support plate.

Turning to FIGS. 3 through 13, one embodiment of the selector assembly 22 is shown that includes, at least in part, a trip-lever receiving well 80 defined in the support plate 55 and a switching assembly 82 that cooperate to shift the trip lever 70 (or portions thereof) to a second operational position where the lever 70 (or at least the lever portion 72) is received in the well 80 as generally shown in FIG. 10. In this second operational position, the lever 70 (or at least the lever portion 72) is in a position where the first stop 56 and/or the second stop 62 will bypass the lever during operation of the sprinkler and, preferably, bypass the lever without engagement therewith. That is, the lever 70 (or at least the portion 72) is positioned spaced from and outside of the path A of the arc stops 56 and 62. Therefore, the nozzle turret 16 rotates in only one direction because neither the first or second stop 56 or 62 will engage the lever 70 as they traverse the path A so that the transmission 54 is not shifted. Full-circle operation, as a result, is accomplished generally without adjustment of the stops 56 and 62 or without adjustment of the transmission 54.

More specifically, when the lever 70 (or at least the lever portion 72) is positioned in the second operational position as shown in FIG. 10, it is preferably shifted to a second operational plane X2, which is preferably axially spaced a distance D1 from the first plane X1 and axially spaced the distance from the arc path A. In this second plane X2, the lever 70 (or at least the lever portion 72) is positioned axially below the upper surface of the support plate and below the stops 56 and 62. As a result, the lever 70 or lever portion 72 is positioned below the path A (i.e., received in the well 80) so that the stops 56 and 62 traverse along the path A during normal sprinkler operation and do not contact or otherwise engage the lever 70 (or at least lever portion 72). In this setting, the lever 70 is not toggled, and the transmission 54 is not shifted so the nozzle turret 16 continues to rotate in a single direction.

Figure 6:
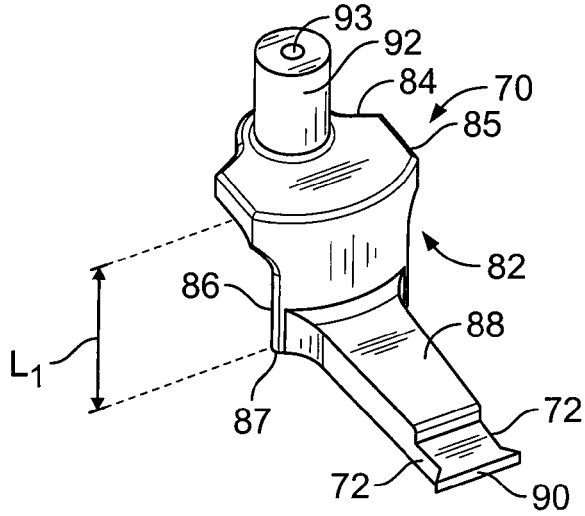
FIG. 6 is a perspective view of an exemplary trip member for the irrigation sprinkler.

Referring now to FIG. 6, one form of the trip member 70 is shown preferably in the form of a lever including a base 82 having an upper longitudinal plate 84 generally in the form of a wedge-like disc. Depending from a distal outer edge 85 of the plate 84 is a depending skirt 86. Extending from the base 82 and, in this example from a lower end 87 of the skirt 86, is a toggle lever extension 88 having one or more of the lever portions 72 (which are engagable with the stops 56 and 62) at opposite sides of a distal end 90 thereof. When mounted on the support plate 55, the lever base 82 is positioned generally centrally thereon (for instance, about the longitudinal axis) with the distal end 90 of the toggle lever extension 88 generally at a radial extent of the plate 55 in a position within the path A to engage the stops 56 and 62 when the lever 70 is in the first operational position described above. When shifted to the second operational position for full-circle operation, the depending skirt 86 has an axial length $L_1$ thereof that permits the toggle lever extension 88 to be received in the well 80 as the lever base longitudinal plate 84 is pushed down towards and positioned adjacent to the support plate 55 via the selector assembly 22 as will be discussed more fully below. As explained above, in this second operational position at least portions of the lever 70 and, preferably, the lever extension 88 is positioned outside of the path A and will not be engaged by the stops 56 and 62.

Extending upwardly from the longitudinal plate 84 is a mount 92 in the form of a an integral tubular extension defining a hollow bore 93, which is positioned to couple the lever 70 to the upper components of the selector assembly 22 as also more fully described below. As with the trip tab described in U.S. Pat. No. 5,383,600, when the lever 70 is configured in the first operational position, it can be toggled back and forth via engagement with one of the stops 56 or 62 between upright stop posts 93 and 94 (FIGS. 4, 7, and 8) extending upwardly from the support plate 55 to shift the transmission 54 from a forward to a reverse rotation of the nozzle turret 16. The stop posts 93 and 94 limit over-toggling of the lever 70 and also preferably maintain alignment of the lever for ease of receipt in the well 80.

Figure 7:
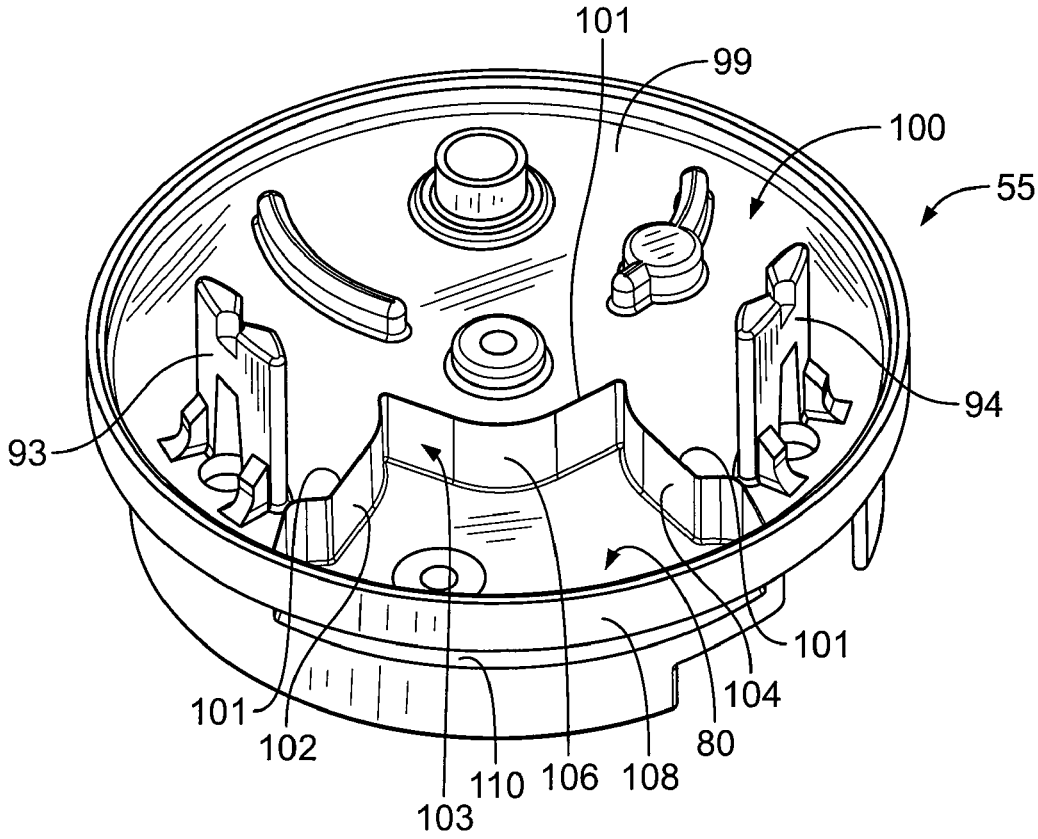
FIG. 7 is a perspective view of an exemplary support plate.
Figure 8:
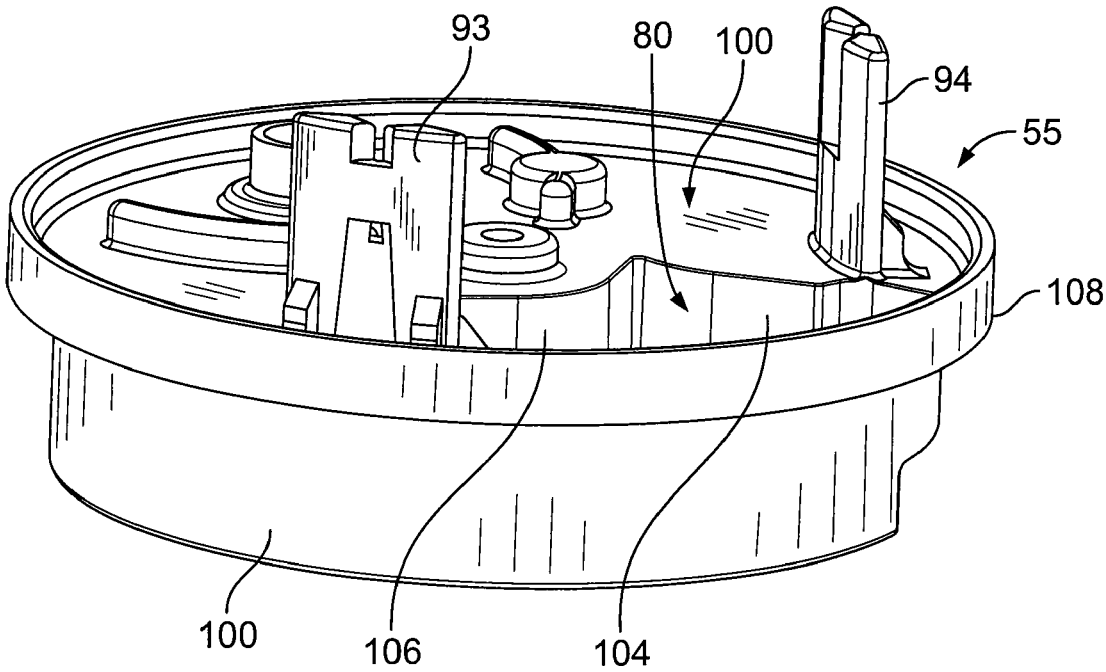
FIG. 8 is a perspective view of an exemplary support plate.

As best shown in FIGS. 7 and 8, the well 80 may be defined in an upper surface 99 of a plate or disc portion 100, which forms a central base of the support plate 55. By one approach, one of the operational planes (X1 or X2) is preferably located on one side of the support plate upper surface 99 and the other operational plane (X1 or X2) is preferably located on another side of the support plate upper surface.

The support upper surface 99 may include an internal edge 101 defining an opening 103 that leads to the well 80 in an axial direction. In one form, the well 80 may be defined by opposing side walls 102 and 104 and a back wall 106 extending downwardly from the upper surface 99 of the disc base 100. By one approach, a front wall 108 of the well 80 may be at least partially opened to form a discharge opening 110 from the well 80 into the internal cavity of the housing 12 (for example, FIG. 7), which may in some instances permit a discharge slot for any debris, water, or other obstruction that could be present in the well 80 so that the lever 70 may be freely received in the well without obstruction that could hinder full receipt of the lever. The opening 110 may also be advantageous because it permits the well 80 to be formed in a support plate that easily mates with the housing 12 and gear drive assembly 50. As shown in FIG. 7, the opening 110 (if used) may be in the form of an arcuate slot generally extending a circumferential length of the front face 108 of the well 80; however, other sizes and shapes of the opening 110 may also be used or the opening 110 may not be used at all (as shown in the exemplary plate of FIG. 8). The well 80 also forms an internal cavity of a sufficient size so that the lever 70 (or at least a portion thereof) may be received in the well 80 regardless of which toggled position the lever 70 is located. To this end, the side walls 102 and 104 of the well 80 are generally positioned axially adjacent the stop posts 93 and 94 so that the lever 70 may be received in the well 80 when engaging these posts or at any position therebetween.

Figure 11:
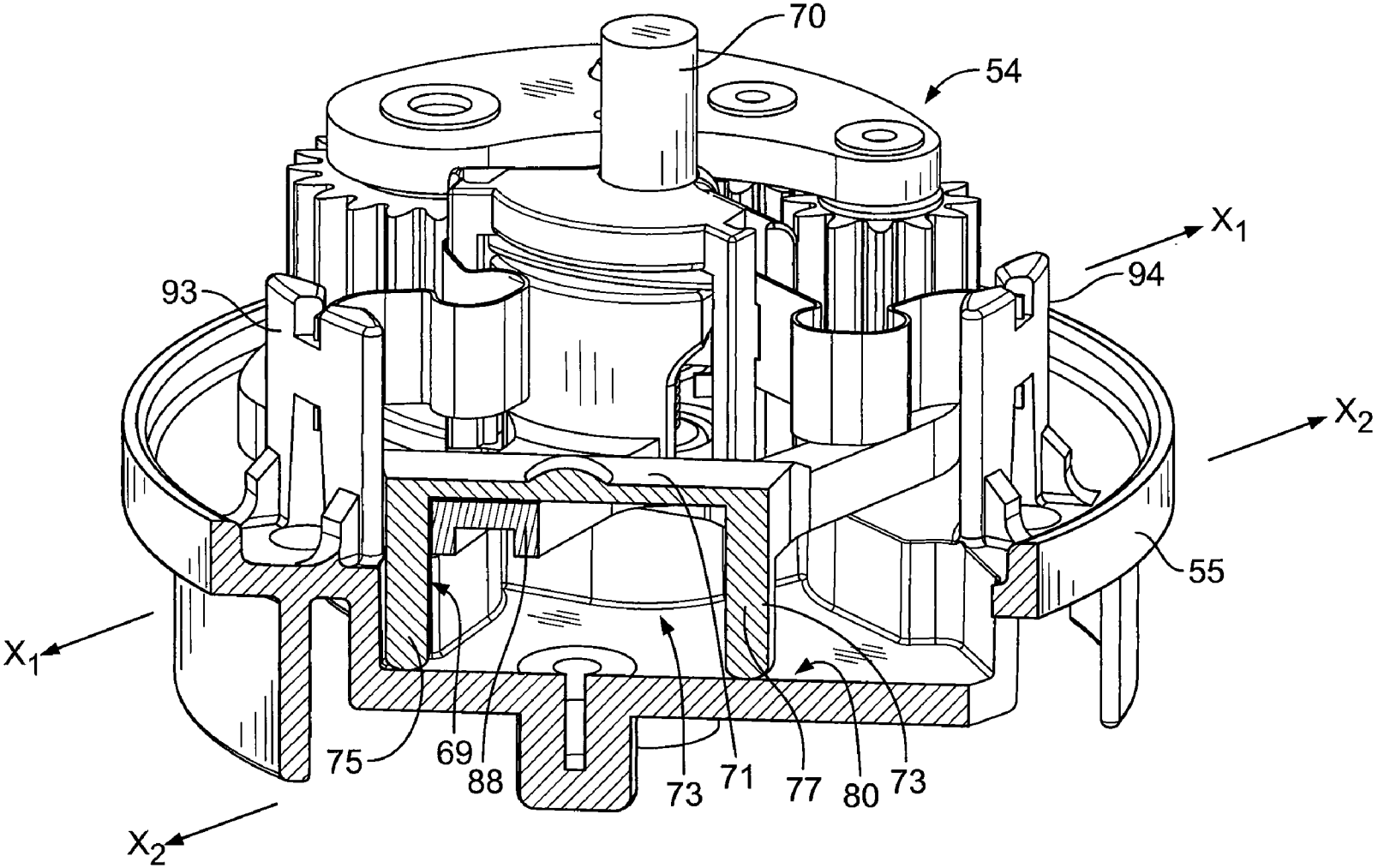
FIG. 11 is a partial cross-sectional view showing portions of a support plate.

Referring to FIG. 11 for a moment, the trip plate 71 is illustrated with an optional guide device 69 including a spaced apart guide track 73 that helps smoothly direct or guide the lever 70 between the first and second operational positions. By one approach, the track 73 of the guide device 69 is shown in the form of a pair of generally parallel-oriented finger or track extensions 75 and 77 that extend downwardly from the trip plate 71 into the well 80. In this form, the fingers or track extensions 75 and 77 have an axial length that extends between the first operational plane X1 and the second operational plane X2 to guide the lever therebetween. As shown, the lever extension 88 is preferably received in a space formed in the track 73, such as in the space formed between the pair of finger extensions 75 and 77 and is operable to toggle back and forth within this space by the stops 56 and 62 as discussed above to shift the transmission 54. The track extensions 75 and 77 preferably extend a sufficient distance into the well 80 so that the lever extension 88 remains received within the track 73 even when the lever 70 is shifted to the second operational position. To this end, the track extensions 75 and 77 preferably are long enough to engage the lower surface of the well 80. This configuration is advantageous because it helps maintain that the lever extension 88 will not get wedged under the trip plate 71 or slide outside of the trip plate 71 when the lever 70 is shifted back to the part-circle operational mode.

Figure 5:
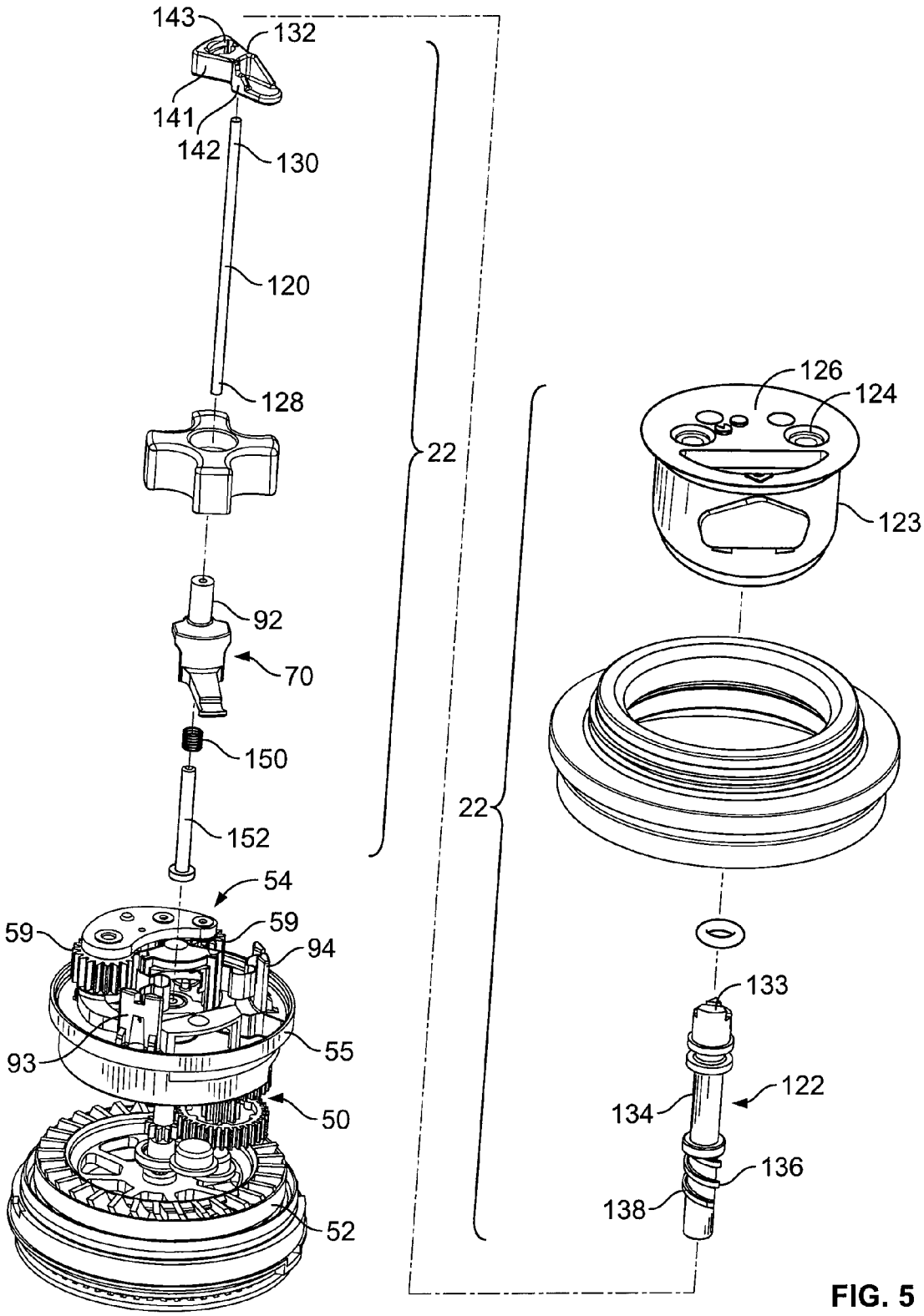
FIG. 5 is an exploded view of portions of the irrigation sprinkler.
Figure 12:
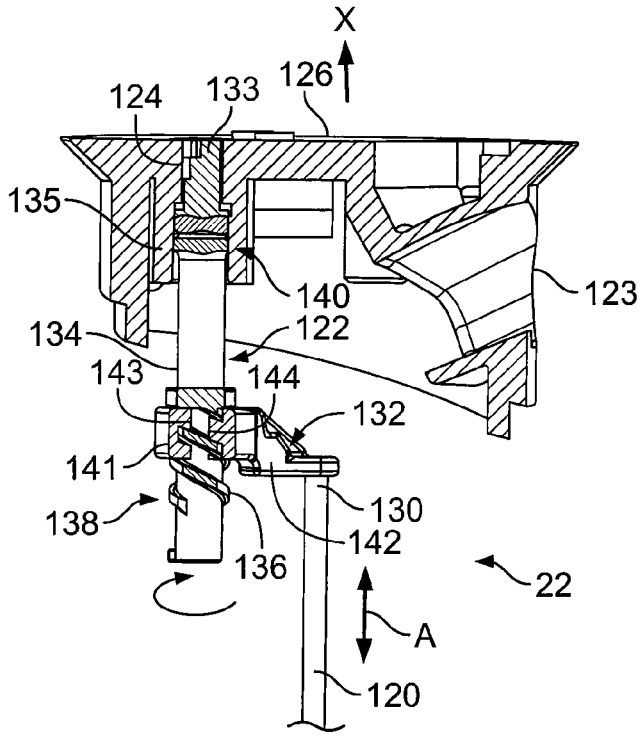
FIG. 12 is a partial cross-sectional view showing portions of a selector assembly.

Turning now to FIGS. 5 and 12, aspects of the selector assembly 22 for shifting the trip member 70 from the first to the second operational position are shown. By one approach, the components of the selector assembly are coupled or linked to the trip member 70 to effect the above described shifting, but at the same time are also generally decoupled from the turret's drive mechanism.

By one approach, the selector assembly 22 includes at least a connecting rod 120 that is configured to be shifted via a user accessible actuator 122 where adjustment of the actuator 122 preferably shifts the lever 70, in this embodiment, in an axial direction from the first operational position for part-circle operation to the second operational position received in the well 80 for full-circle operation. By one approach, the actuator 122 is positioned for adjustment from a user by being mounted in an upper cap 123 of the nozzle turret 16 and, preferably, exposed through an aperture 124 in an upper surface 126 of the cap 123. The connecting rod 120 is coupled to and transmits the adjustment from the actuator 122 to the lever 70. To this end, a lower end 128 of the rod 120 is connected to the mount 92 of the lever 70 and an upper end 130 of the rod 120 is engaged to or abuts a cross-linkage 132 that couples the rod 120 to the actuator 122. In this embodiment, the connecting rod 120 is mounted for sliding in an axial direction along the longitudinal axis X; as a result, the connecting rod 120 transmits the adjustment from the actuator 122 to the lever 70 and preferably shifts the lever 70 up and down in an axial direction. In one aspect of this embodiment, there is a rotational interface between the end 130 of the connecting rod 120 and the cross-linkage or bridge 132 so that the linkage 132 can travel or orbit along with the turret 16 but the actuator 122 and linkage 132 are otherwise not directly driven by the drive mechanism because they are free to rotate about the rod end 130.

More specifically, the actuator 122 is preferably in the form of a jack screw 134 having external threading 136 on at least a lower portion 138 thereof. The top of the jack screw 134 may include a slot or other profile 133 configured to receive a screw driver or other tool to permit turning of the jack screw to shift the lever 70 from the first to the second operational position. As best shown in FIG. 12, an upper portion 140 of the jack screw 134 is rotatively mounted in the cap 123, such as received in a cylindrical coupling 135 configured to permit the jack screw to rotate but, preferably, retain the jack screw in its axial position so that turning of the screw 134 does not shift it axially.

The linkage 132 includes a nut portion 141 extending from a lower plate 142 that is fixed to the rod upper end 130. The nut portion 141 defines a throughbore 143 having internal threading 144 configured to threadably mate with the external threading 136 of the jack screw 134. The threaded portion 138 of the jack screw 134 is then threaded into the bore 143 of the linkage 132 so that, when the jack screw is turned by a user, the mated threadings 136 and 144 imparts an axial, linear motion A to the linkage 132, which pushes the rod 120 and results in a corresponding axial, linear motion of the rod 120 along the sprinkler's longitudinal axis X. Such axial motion of the rod 120 shifts the lever 70 into the well 80 between the first and second operational positions.

For example, to shift the sprinkler to full-circle operation, a user turns the jack screw 134 to push the rod 120 in an axial direction A to shift the lever toggle extension 88 into the well 80. To shift the sprinkler back to part-circle operation, the user turns the jack screw in the opposite direction to raise the linkage 132 to pull or otherwise allow the rod 120 to be raised in an opposite axial direction to pull to shift the lever toggle extension 88 out of the well. Preferably, the selector assembly 22 also includes a biasing member 150 (FIG. 13) that biases the lever 70 and shaft 120 upwardly to the part-circle position as the linkage 32 is raised by the actuator.

Figure 13:
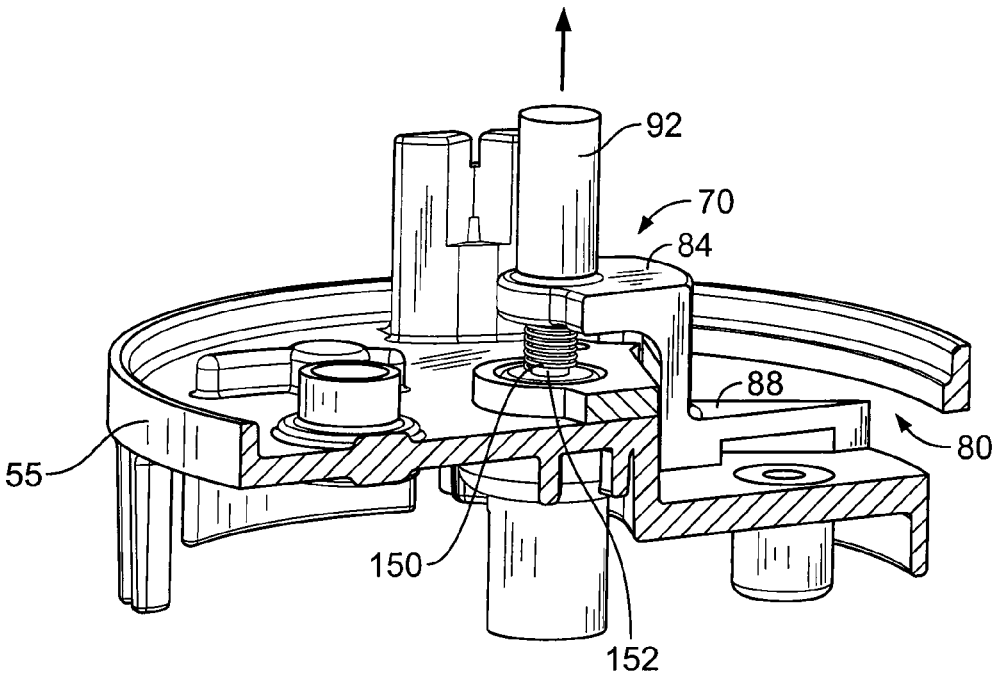
FIG. 13 is a partial cross-sectional view of the support plate and trip member showing a biasing member therebetween.

Turning now to FIG. 13, the biasing member 150 of the selector assembly 22 is shown in more detail. Preferably, the biasing member 150 can be provided in some instances to assist in shifting the lever 70 upwards out of the well 80 as the user turns the jack screw 134. By one approach, the biasing member 150 may be in the form of a coil spring positioned to provide an upwards biasing force towards an underside of the lever longitudinal base plate 84 to help urge the lever 70 out of the well 80. To help correctly position the biasing member 150 on the underside of the lever plate 84, a centering post 152 may be provided that is also slidably received in the lever mount 92. The biasing member 150, such as the coil spring, can then be wound around the centering post 152 to align the coil spring on the underside of the plate 84. When the lever 70 (or at least a portion thereof) is shifted to the second operational position into the well 80 for full circle operation, it may be positioned to provide a downward force in order to counter bias or compress the biasing member 150 as needed to be received in the well 80. Therefore, as the linkage 132 is raised, the biasing member 150 urges the lever 70 and rod 120 upwardly to shift the lever 70 out of the well 80. In this exemplary configuration, the biasing member 150 urges or permits the lever 70 to default to the first or part-circle operational mode (assuming the actuator and linkage has not shifted the lever to the full-circle mode).

Figure 14:
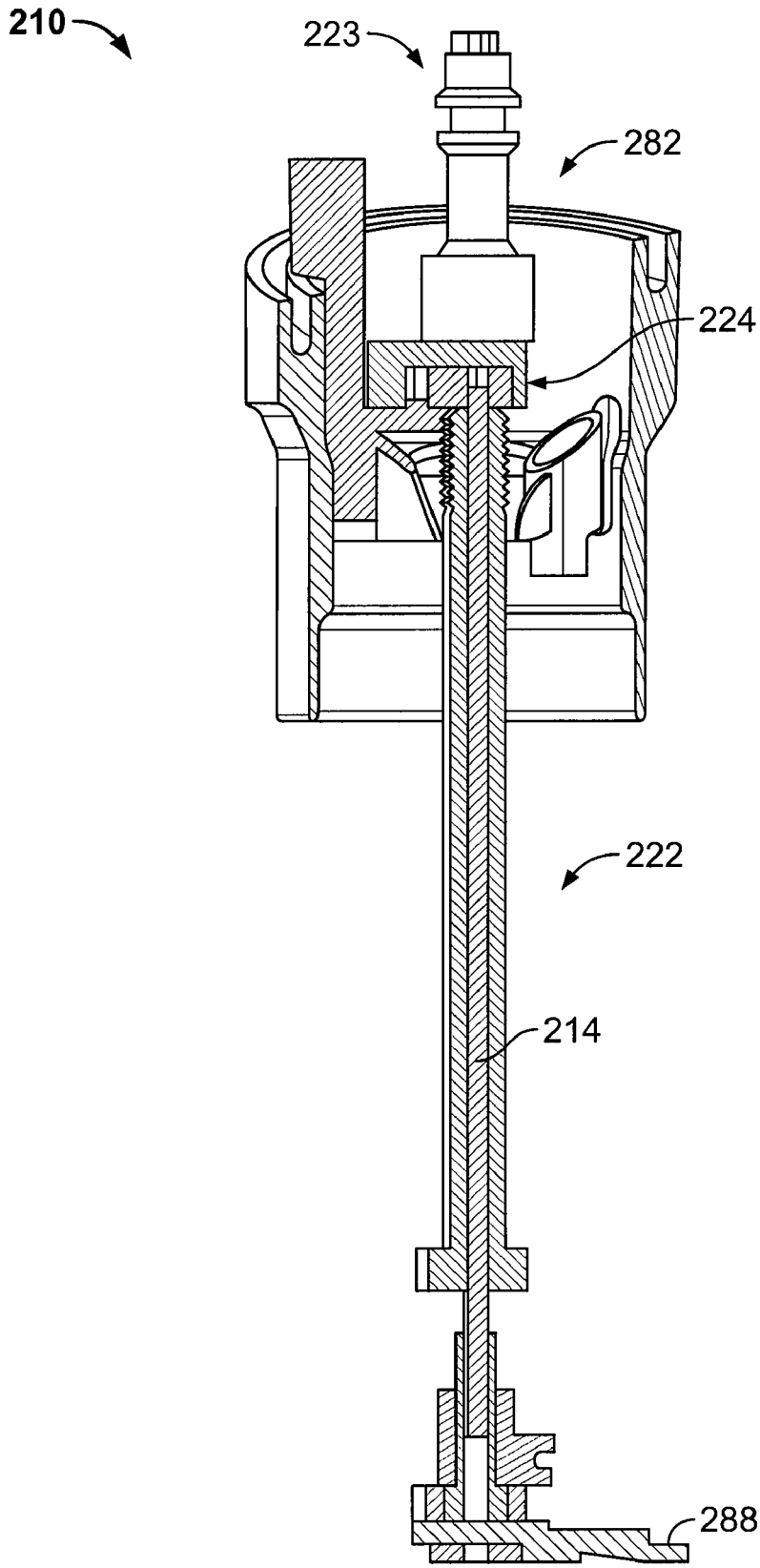
FIG. 14 is a cross-sectional view of a second embodiment of portions of an irrigation sprinkler rotor.
Figure 15:
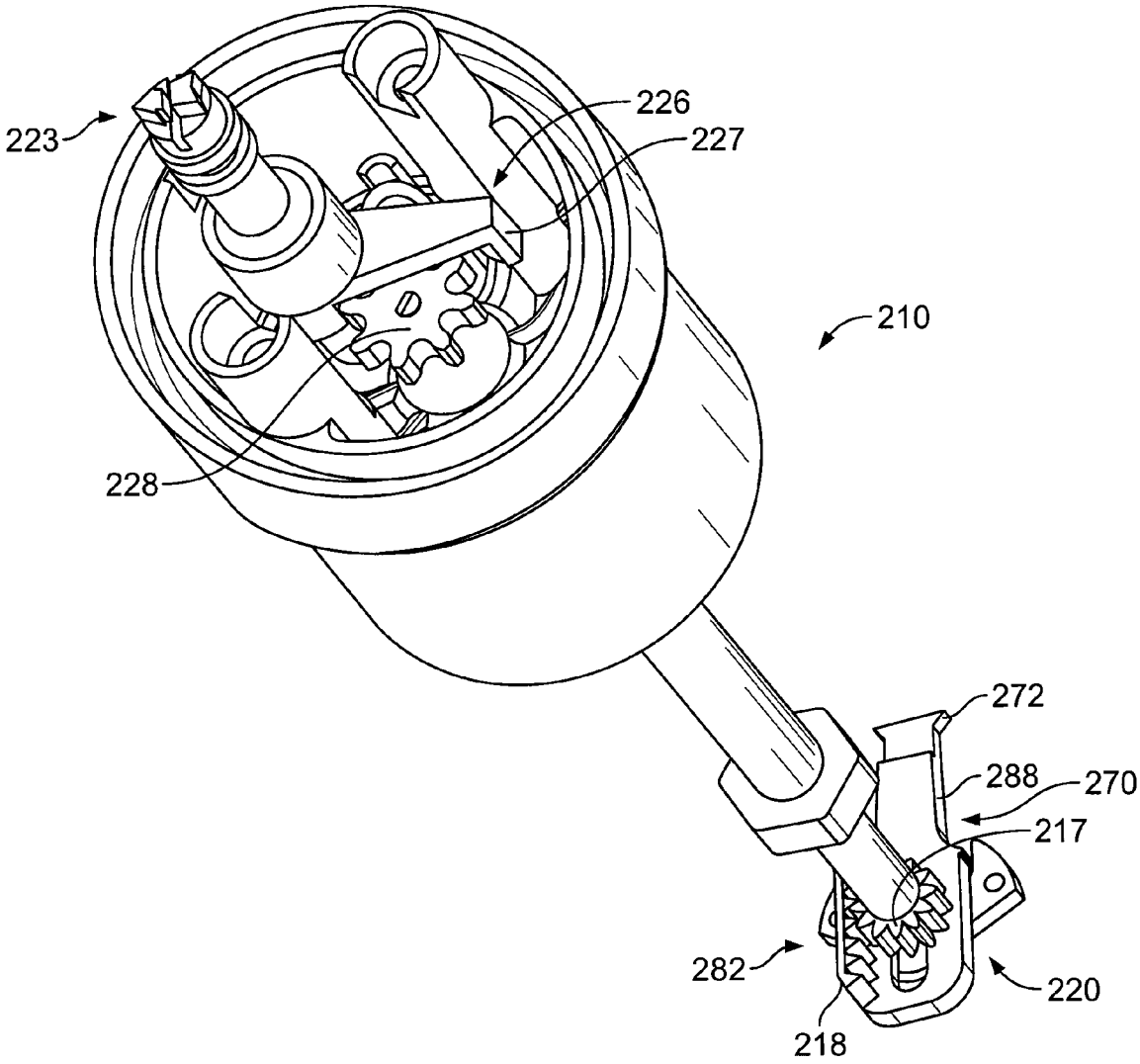
FIG. 15 is a partial perspective view of the second embodiment of the irrigation sprinkler rotor in a first operational position.
Figure 16:
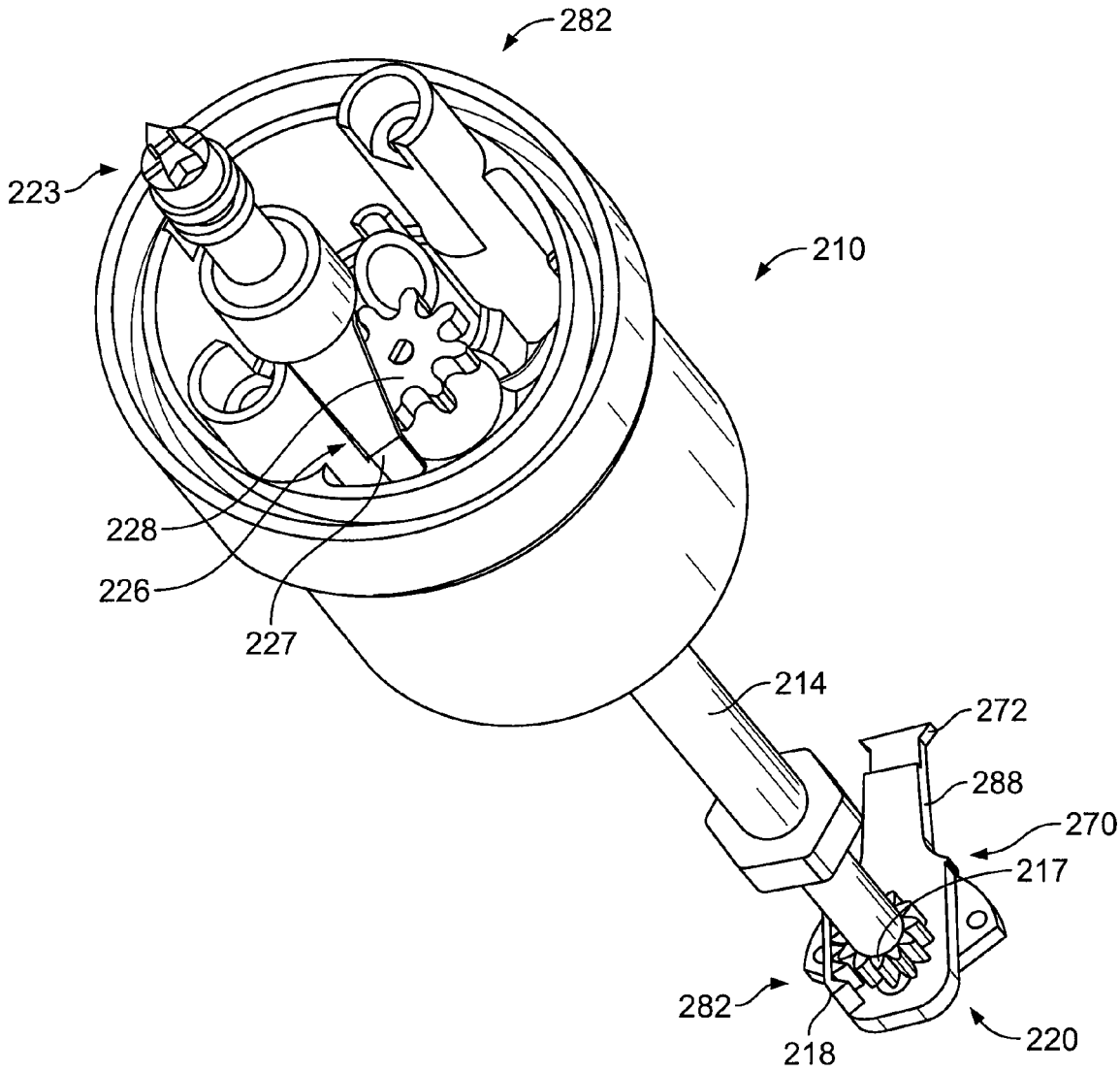
FIG. 16 is another partial perspective view of the second embodiment of the irrigation sprinkler rotor in a second operational position.

Turning to FIGS. 14 to 16, a second embodiment of a full-circle and part-circle sprinkler 210 is provided. In this embodiment, the sprinkler 210 may be similar to the previous sprinkler 10 except it includes a modified switching assembly 222 that extends or retracts a modified lever toggle arm 288 from the first operational position to the second operational position. In this embodiment, the second operational position for full-circle operation (FIG. 14) includes the trip lever 270 in a radially retracted position where the stops 56 and 62 can bypass the lever 270. That is, the lever 270 or at least a portion 272 thereof is retracted radially outside of the arc path A. In part-circle operation (FIGS. 14 and 16), the trip lever 270 is in a radially extended position to so that the lever portion 272 is positioned within the path A to engage one of the stops 56 or 62 to reverse direction of the nozzle as described above.

In this embodiment, to switch between full-circle and part-circle operation, the trip level 270 is retracted radially to the position of FIG. 15 so that it is no longer in a position within the path A to engage the stops. By this approach, a selector mechanism 282 is provided that may include a rack and pinion gear 220 that is operable to extend and retract the lever 270. In other words, the selector mechanism 282 operates to move the trip lever 270 between the extended position of FIGS. 14 and 16 in the first operational position, where the trip lever 270 is positioned to engage the stops 56 and 62 (i.e., part-circle rotation mode), and the radially retracted position of FIG. 15 in the second operational position, where the trip lever 270 is withdrawn so that the stops 56 and 62 can rotate by passing the lever 270 and, preferably, without engaging the lever 270 (i.e., full-circle rotation mode). As best shown in FIGS. 14 and 15, a connecting rod 214 mounted for rotation in this embodiment is connected to the rack and pinion gear assembly 220. Specifically, the rod 214 is mounted to rotate a pinion gear 217 and the lever 270 includes an elongate rack gear 218 having gear cogs that cooperating with the pinion gear 217. As a result, rotational motion of the connecting rod 214 in this embodiment is converted to linear motion to extend or retract the lever 270 via the rack and pinion gear 220. This configuration also includes a guide device to smoothly shift the lever 270 between the two positions. Here, the rack 218 can guide the lever 270 between the two operational positions.

To select either the full-circle or part-circle mode in this embodiment, the selector assembly 282 also includes an actuator 223 and a transfer mechanism 224 that transfers the user's selection of the actuator 223 to the lever 270 within the sprinkler body. The actuator 223 preferably includes an upper end configured, such as with a slot, for engagement by a tool so that the lever 270 can be easily switched between rotation modes without disassembling the rotor mechanism. The actuator 223 is operably connected to the trip lever 270 via the connecting rod 214 so that rotation of the actuator 223 by a user either retracts or extends the lever 270 via the rack and pinion gear 217 and 218. To this end, the actuator 223 is connected to the transfer mechanism 224, which couples the position of the actuator 223 to the lever 270 via the connecting rod 214.

More specifically, the transfer mechanism 224 includes a transfer lever 226 and transfer gear 228 that communicates the rotary position of the actuator 223 to the lever 270. For example, rotation of the actuator 223 causes a corresponding rotation of the transfer lever 226. The transfer lever 226 has a dog eared distal end 227, which engages one of the gear cogs of the transfer gear 228. Therefore, rotation of the transfer lever 226 imparts a corresponding rotational force to the gear 228 via the dog eared end 227 of the transfer lever 226. Because the transfer gear 228 is coupled to the connecting rod 214, rotation of the transfer gear 228 also rotates the rod 214 in a corresponding direction. Rotation of the rod 214 imparts a corresponding rotation to the pinion gear 217, which causes either linear extension or retraction of the trip lever 270 via the mated gear rack 218.

It will be understood that various changes in the details, materials, and arrangements of parts and components which have been herein described and illustrated in order to explain the nature of the sprinkler may be made by those skilled in the art within the principle and scope of the sprinkler as expressed in the appended claims. Furthermore, while various features have been described with regard to a particular embodiment, it will be appreciated that features described for one embodiment may also be incorporated with the other described embodiments.

What is claimed is:

1. An irrigation sprinkler rotor having a full-circle and a part-circle operation mode, the irrigation sprinkler rotor comprising:

a housing with an inlet for receiving fluid for irrigation;

a riser stem mounted to the housing and movable between a retracted position and an elevated position relative to the housing, the riser stem having a longitudinal axis therealong;

a turret mounted for rotation relative to the riser stem;

a drive mechanism for rotating the turret in one of a full-circle or a part-circle operation;

at least a pair of arc stops disposed in a first operational plane relative to the longitudinal axis and mounted for movement with the nozzle turret;

a shiftable transmission powered by the drive mechanism and operable to oscillate the turret in part-circle operation between the pair of arc stops; and a trip lever arranged and configured to be shifted in an axial direction from the first operational plane to a second operational plane, the second operational plane spaced an axial distance from the first operational plane;

when the trip lever is positioned in the first operational plane, it is configured to be shifted by the arc stops in order to shift the transmission to oscillate the turret in part-circle operation; and when the trip lever is positioned in the second operational plane, it is configured so that the arc stops bypass the trip lever for rotation of the turret in full-circle operation.

2. The irrigation sprinkler rotor of claim 1, further comprising a support plate having an upper surface for supporting at least the trip lever, the support plate defining an opening through the upper surface, and the first operational plane positioned on one side of the support plate upper surface and the second operational plane below the support plate upper surface.

3. The irrigation sprinkler rotor of claim 2, wherein the support plate includes a well defined by at least side walls and a back wall depending from the support plate upper surface, the trip lever received in the well when in the second operational plane.

4. The irrigation sprinkler rotor of claim 3, wherein the trip lever includes a base plate, a skirt depending from an outer edge of the base plate, and a lever extension on a lower end of the depending skirt, the lever extension movable between the first to the second operational planes.

5. The irrigation sprinkler rotor of claim 1, further comprising a switching mechanism including an actuator coupled to the trip lever, the actuator configured for axial shifting of the trip lever from the first operational plane to the second operational plane, and the actuator and switching mechanism being decoupled from the drive mechanism for rotating the turret.

6. The irrigation sprinkler rotor of claim 5, wherein the switching mechanism further includes a shaft having opposite ends and coupled to the trip lever on one of the opposite ends and coupled to the actuator on the other of the opposite ends, and actuation of the actuator imparts a translational movement to the shaft in an axial direction to shift the trip lever back and forth between the first and the second operational planes.

7. The irrigation sprinkler rotor or claim 1, further comprising a biasing member to apply a biasing force against the trip lever when in the second operational plane.

8. An irrigation sprinkler rotor selectable between full-circle rotation and part-circle oscillation modes, the irrigation sprinkler rotor comprising:

a housing body with a longitudinal axis therethrough;

a nozzle turret mounted for rotation relative to the housing body and having at least one nozzle therein for projecting a fluid spray outwardly therefrom;

at least a pair of arc adjustment stops for defining an arc of rotation of the nozzle turret relative to the housing body and between the arc adjustment stops when the sprinkler rotor is in the part-circle oscillation mode;

the arc adjustment stops traveling along a path relative to the housing body during rotation of the nozzle turret;

a drive mechanism for rotating the nozzle turret;

a shiftable transmission coupled to the drive mechanism and operable to oscillate the nozzle turret in the part-circle oscillation mode between the arc adjustment stops;

a trip arm coupled to the transmission and configured for shifting between a first operational position where at least a portion of the trip arm is positioned within the path of the arc adjustment stops to be engaged by the arc adjustment stops for shifting the transmission in the part-circle oscillation mode, and a second operational position spaced a distance from the first operational position where the at least a portion of the trip arm is positioned outside of the path of the arc adjustment stops so that the arc adjustment stops bypass the trip arm during rotation of the nozzle turret for operation in the full-circle rotation mode.

9. The irrigation sprinkler rotor of claim 8, further comprising a support plate having an upper surface and disposed in the housing body for supporting at least the trip arm, the support plate defining an opening in the upper surface thereof, the opening being sized for at least the portion of the trip arm to pass through to the second operational position.

10. The irrigation sprinkler rotor of claim 9, wherein the support plate defines a well formed by at least spaced side walls and a back wall extending downwardly from the plate upper surface, the well defining a cavity sized to receive the at least a portion of the trip arm in the second operational position.

11. The irrigation sprinkler rotor of claim 10, wherein the opening in the support plate upper surface leads to the well cavity in an axial direction.

12. The irrigation sprinkler rotor of claim 8, further comprising a guide device defining a track to guide the trip arm back and forth between the first and second operational positions.

13. The irrigation sprinkler rotor of claim 8, wherein the trip arm includes a base and a lever extending outwardly from the base, the lever having a distal end portion positioned within the path of the arc adjustment stops to be engaged by the arc adjustment stops when the lever is in the first operational position, and the lever configured to be toggled back and forth by engagement with the arc adjustment stops to shift the transmission.

14. The irrigation sprinkler rotor of claim 13, wherein the trip arm base includes a depending skirt where the lever extends from a lower end of the depending skirt.

15. The irrigation sprinkler rotor of claim 14, wherein the housing body includes a support plate having an upper surface for supporting at least the trip arm, the support plate defining an opening in the upper surface sized for at least a portion of the extending lever to pass through to the second operational position.

16. The irrigation sprinkler rotor of claim 15, wherein the skirt has an axial length so that when the trip arm base is positioned adjacent the upper surface of the support plate, the skirt positions the extending lever through the support plate opening into the second operational position.

17. The irrigation sprinkler rotor of claim 13, further comprising a biasing member positioned to provide a biasing force against the trip arm base to help shift the trip arm from the second operational position to the first operational position.

18. The irrigation sprinkler rotor of claim 8, further comprising a selector assembly including a shaft coupled to an end of the trip arm and a user accessible actuator also coupled to the shaft, the actuator arranged and configured so that shifting the actuator imparts a movement of the shaft about the longitudinal axis to shift the trip arm back and forth between the first operational position and the second operational position.

19. The irrigation sprinkler rotor of claim 18, wherein the shaft is configured to slide up and down along the longitudinal axis to shift the trip arm back and forth between the first operational position and the second operational position.

20. The irrigation sprinkler rotor of claim 18, wherein the shaft is configured to rotate about the longitudinal axis to shift the trip arm back and forth between the first operational position and the second operational position.

21. The irrigation sprinkler rotor of claim 18, wherein the actuator includes threading thereabout and the selector assembly includes a linkage coupling the shaft to the threading, the linkage defining a nut configured to cooperate with the threading.

22. The irrigation sprinkler rotor of claim 21, wherein the threading is on a jack screw and the nut defines a bore having inwardly extending threading arranged to cooperate with the threading of the jack screw, rotation of the jack screw causes the nut and shaft to translate in an axial direction to shift the trip arm back and forth between the first operational position and the second operational position.

23. The irrigation sprinkler rotor of claim 8, wherein the trip arm is arranged and configured to extend and retract radially in a direction generally transverse to the longitudinal axis so that the second operational position of the trip arm is spaced radially inward from the first operational position.

24. An irrigation sprinkler rotor selectable between full-circle rotation and part-circle oscillation modes, the irrigation sprinkler rotor comprising:

a housing body with a longitudinal axis therethrough;

a nozzle turret mounted for rotation relative to the housing body and having at least one nozzle therein for projecting a fluid spray outwardly therefrom;

at least a pair of arc adjustment stops for defining an arc of rotation of the nozzle turret relative to the housing body and between the arc adjustment stops when the sprinkler rotor is in the part-circle oscillation mode;

a drive mechanism for rotating the nozzle turret;

a shiftable transmission coupled to the drive mechanism and operable to oscillate the nozzle turret in the part-circle oscillation mode between the arc adjustment stops;

a trip arm coupled to the transmission and configured for shifting between a first operational position where at least a portion of the trip arm is positioned to be engaged by the arc adjustment stops for shifting the transmission in the part-circle oscillation mode and a second operational position where the trip arm is positioned so that the arc adjustment stops bypass the trip arm during rotation of the nozzle turret for operation in the full-circle rotation mode; and a switching mechanism for effecting the switching of the trip arm from the first to the second operational position, the switching assembly including an actuator mounted to the turret that is coupled to the trip arm to effect the switching thereof and the actuator is decoupled from the drive mechanism that rotates the turret.

25. The irrigation sprinkler rotor of claim 24, wherein the switching mechanism further includes a shaft having opposite ends and coupled to the trip arm at one end thereof and to the actuator at the other end thereof, a rotational interface between the actuator and the shaft to permit the nozzle turret to rotate thereabout, the rotational interface imparts a movement of the shaft separate from the rotation of the turret about the longitudinal axis to shift the trip arm back and forth between the first operational position and the second operational position.

26. The irrigation sprinkler rotor of claim 25, wherein the shaft is configured to slide up and down along the longitudinal axis upon adjusting the actuator to shift the trip arm back and forth between the first operational position and the second operational position.

27. The irrigation sprinkler rotor of claim 25, wherein the shaft is configured to rotate about the longitudinal axis upon adjusting the actuator to shift the trip arm back and forth between the first operational position and the second operational position.

28. The irrigation sprinkler rotor of claim 25, wherein the actuator is positioned in the turret off-center from the longitudinal axis and the shaft is spaced from the actuator along the longitudinal axis, the actuator further includes threading and a linkage bridge that couples the shaft to the threading, the linkage bridge defining a nut configured to cooperate with the threading.

29. The irrigation sprinkler rotor of claim 28, wherein the threading is on a rotatable jack screw and the nut defines a bore having inwardly extending threading arranged to cooperate with the threading of the jack screw, rotation of the jack screw causes the nut and linkage bridge to translate in an axial direction to shift the trip arm back and forth between the first operational position and the second operational position.

* * * * *

UNITED STATES PATENT AND TRADEMARK OFFICE

CERTIFICATE OF CORRECTION

PATENT NO. : 7,850,094 B2
APPLICATION NO. : 12/353139
DATED : December 14, 2010
INVENTOR(S) : Douglas Scott Richmond et al.

It is certified that error appears in the above-identified patent and that said Letters Patent is hereby corrected as shown below:

IN THE CLAIMS:

Column 10, line 62, in claim 7, delete "or" and insert --of-- therefor.

Signed and Sealed this
Twenty-fifth Day of August, 2015

Michelle K. Lee

Michelle K. Lee
*Director of the United States Patent and Trademark Office*